US007690746B2

(12) United States Patent
Mantell et al.

(10) Patent No.: US 7,690,746 B2
(45) Date of Patent: Apr. 6, 2010

(54) SYSTEMS AND METHODS FOR DETECTING PRINT HEAD DEFECTS IN PRINTING CLEAR INK

(75) Inventors: David A. Mantell, Rochester, NY (US); Jason O'Neil, Rochester, NY (US); Kenneth R. Ossman, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 119 days.

(21) Appl. No.: 12/053,206

(22) Filed: Mar. 21, 2008

(65) Prior Publication Data

US 2009/0237434 A1 Sep. 24, 2009

(51) Int. Cl.
*B41J 29/38* (2006.01)

(52) U.S. Cl. ..... 347/14; 347/19

(58) Field of Classification Search ..... 347/4, 347/19–21, 49, 14, 99, 102
See application file for complete search history.

(56) References Cited

U.S. PATENT DOCUMENTS 5,122,187 A 6/1992 Schwarz et al.
6,378,976 B1 * 4/2002 Byers et al. ..... 347/19
6,425,650 B1 * 7/2002 Walker et al. ..... 347/14
6,906,118 B2 6/2005 Goodbrand et al.
6,948,793 B2 * 9/2005 Bronswijk et al. ..... 347/19
7,300,133 B1 11/2007 Folkins et al.

OTHER PUBLICATIONS

U.S. Appl. No. 11/554,871, filed Oct. 31, 2006 (Iftime et al.).
U.S. Appl. No. 11/683,193, filed Mar. 7, 2007 (Iftime et al.).
U.S. Appl. No. 11/837,585, filed Aug. 13, 2007 (Wosnick et al.).
U.S. Appl. No. 12/029,065, filed Feb. 11, 2008 (Iftime et al.).
U.S. Appl. No. 11/548,774, filed Oct. 12, 2006 (Iftime et al.).
U.S. Appl. No. 11/548,775, filed Oct. 12, 2006 (Iftime et al.).

* cited by examiner

*Primary Examiner*—Thinh H Nguyen
(74) *Attorney, Agent, or Firm*—Oliff & Berridge, PLC

(57) ABSTRACT

A method for detecting a defect in an inkjet print head for printing a substantially clear ink includes including an ultraviolet or infrared sensitive material in the substantially clear ink, marking a test image on a substrate by jetting the substantially clear ink through one or more jets of the inkjet print head to be evaluated, exposing the test image to activating radiation having a wavelength to which the included ultraviolet or infrared sensitive material responds. During or following the exposing, the test image is evaluated with an image sensor, and whether the inkjet print head or any one of the one or more jets thereof being evaluated is defective is then determined based on the evaluation. A system for the method is also set forth.

17 Claims, 3 Drawing Sheets

SYSTEMS AND METHODS FOR DETECTING PRINT HEAD DEFECTS IN PRINTING CLEAR INK

BACKGROUND

Described herein are systems and methods for detecting ink jet print head defects when printing substantially clear, colorless inks. More in particular, described are systems and methods that detect print head defects by incorporating an ultraviolet (UV) or infrared (IR) sensitive material into the substantially clear ink, which UV or IR sensitive material is substantially invisible to the naked human eye under ambient light conditions, and thus does not alter the appearance of the substantially clear ink under such ambient light conditions, but which becomes visible, and thus machine readable or detectable, upon exposure to activating radiation (light) of the appropriate wavelength. The exposure of an image formed with a substantially clear ink printed through the ink jet head to the activating radiation can thus be used to allow for any defects in the ink jets of the head to be detected. Subsequent appropriate corrective action can then be taken.

Substantially clear overcoats are known and have several utilities, for example including in use as a filler ink in eliminating print ghosts, or as a patterned or full overcoat to adjust image gloss or to protect previously deposited color ink image, for example against scratches and the like. Such overcoats are known, and may be applied as either a blanket over an entire image or as a selectively applied and/or patterned overcoat.

Prior procedures for applying substantially clear overcoats have included flood coating techniques and the like for covering an entire image.

Although it may be desirable to be able to evaluate the accuracy of the application of the substantially clear ink to the substrate, for example in order to ensure appropriate coverage of the image by the substantially clear ink as a result of the ink jets of the ink jet head accurately applying the substantially clear ink to the substrate, such is difficult to accomplish when using a substantially clear ink because the ink is not readily detectable. As a result, defects such as clogging, misalignment and the like in the print head are not detectable when printing a substantially clear ink from the ink jet head.

SUMMARY

What is desired is an ink jet method for forming clear ink materials onto a substrate, for example as an overcoat material that is applied over an entire substrate and/or underlying image, or selectively applied over only portions of a substrate and/or underlying image. Such printing requires use of an ink jet print head.

It is further desirable that the clear ink be applied in an adequate and accurate manner over the image receiving substrate. Problems may arise where, for example, the inkjet print head as a whole becomes misaligned and/or one or more ink jets of the inkjet head used to apply the substantially clear jettable ink become inoperable or defective, for example as a result of a clog, misalignment, mechanical failure and the like. Such an occurrence will result in the substantially clear ink being incorrectly applied to the substrate and/or being incompletely applied to the substrate, potentially negatively impacting the gloss, appearance and/or durability of the overall image.

With a clear ink, however, it is difficult to evaluate an image to determine if one or more ink jets are defective. Often, not until a print is recognized by human evaluation to have a noticeable defect is a problem with a print head found. This may be long after one or more jets of the print head have become defective, and thus long after a large number of images with potential defects in the application of the substantially clear ink have been printed with the device. It is thus desirable when using a substantially clear ink that is to be jetted with an ink jet head to be able to evaluate the ink jets, for example either by the print device itself or a system associated with the print device, in order to earlier detect the presence of defective ink jets. This would permit a reduction in the number of defective printed images formed by the print device, and permit earlier corrective action to be taken with respect to ink jets found to be defective.

Described is a method for detecting a defect in an inkjet print head for printing a substantially clear ink, comprising including an ultraviolet or infrared sensitive material in the substantially clear ink; marking a test image on a substrate by jetting the substantially clear ink through one or more jets of the inkjet print head to be evaluated; exposing the test image to activating radiation having a wavelength to which the included ultraviolet or infrared sensitive material responds; during or following the exposing, and while the ultraviolet or infrared sensitive material is responding to the exposing, evaluating the test image with an image sensor; and determining whether the inkjet print head or any one of the one or more jets thereof is defective based on the evaluation.

Also described is a method for forming a substantially clear ink image on an image receiving substrate, comprising (1) a process of forming an image comprised of substantially clear ink on an image receiving media by forming a pattern of substantially clear ink onto a surface of the image receiving media by jetting the substantially clear ink through one or more ink jets of an inkjet print head, wherein the jetting is either direct by jetting directly onto the surface of the image receiving media or is indirect by jetting onto an intermediate substrate with the pattern subsequently being transferred from the intermediate substrate to the surface of the image receiving media, and wherein the substantially clear ink includes an ultraviolet or infrared sensitive material; and (2) a process of forming a test image for evaluation of defects in the inkjet print head or the one or more ink jets thereof by forming the test image comprised of the substantially clear ink by jetting the substantially clear ink through the one or more jets of the inkjet print head; moving the test image past a radiation emitting device that emits radiation at a wavelength to which the ultraviolet or infrared sensitive material is sensitive to cause the ultraviolet or infrared sensitive material to be activated, and moving the test image past an image sensor while the ultraviolet or infrared sensitive material is activated, where the test image is evaluated; and determining whether the inkjet print head or any of the one or more jets thereof is defective based on the evaluation.

Further described is a system for detecting a defect in one or more ink jets of an inkjet print head that prints a substantially clear ink, comprising an inkjet print head associated with a substrate, wherein the substrate moves past the inkjet print head; an image sensor downstream from the inkjet print head, wherein the substrate moves past the image sensor following the formation of an image comprised of substantially clear ink including an ultraviolet or infrared sensitive material on the substrate by the inkjet print head; and a radiation emitting source, located upstream of or at the image sensor, wherein the radiation emitting source emits radiation having a wavelength activating the ultraviolet or infrared sensitive material of the substantially clear ink.

EMBODIMENTS

Figure 1:
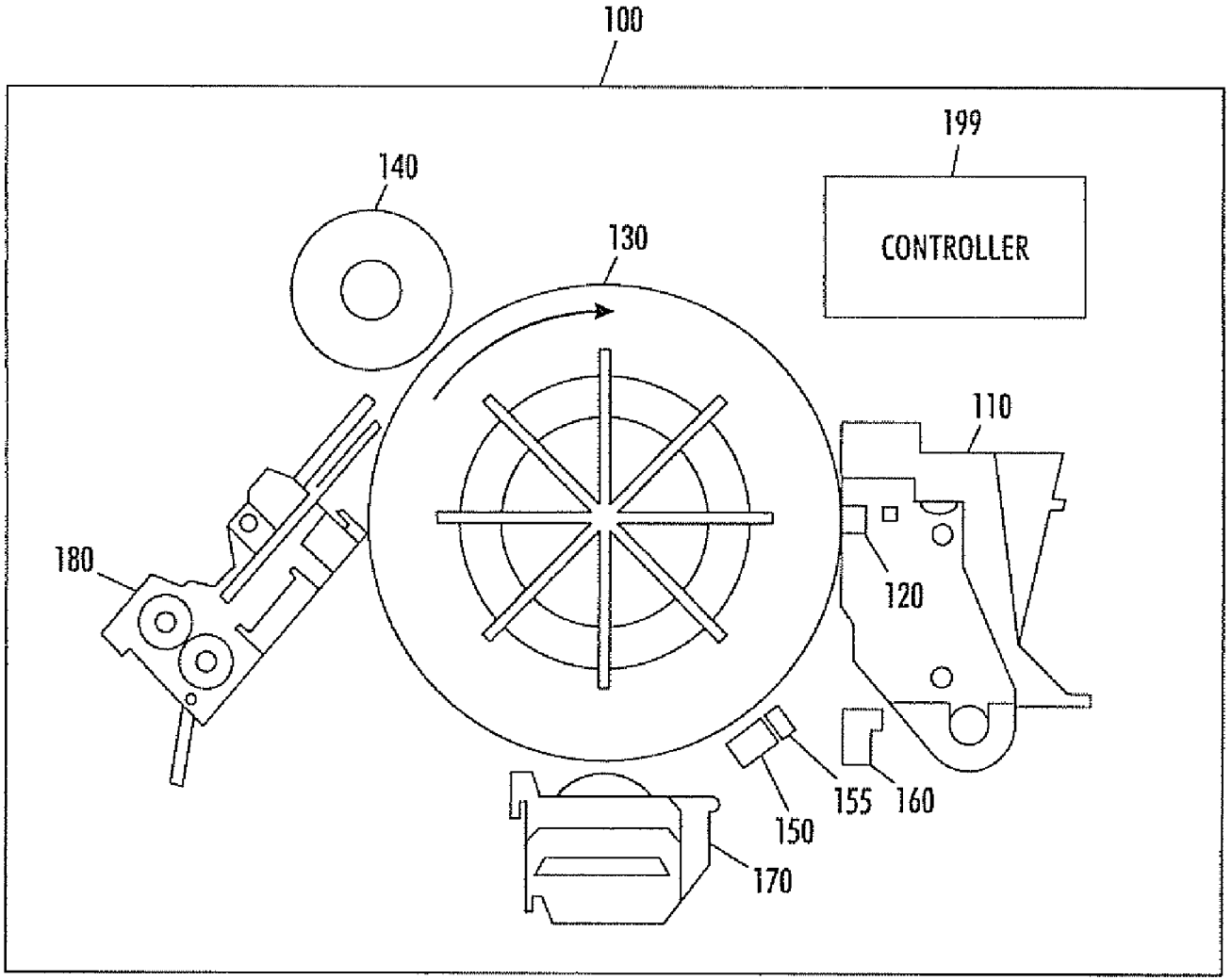
FIG. 1 shows an exemplary embodiment of an inkjet print device configured for marking images on an intermediate substrate drum.

Inkjet print devices, such as, for example, a solid inkjet printer, an ink-jet printer, or an inkjet facsimile machine, are known wherein an inkjet print head moves relative to and ejects marking material toward a substrate. In direct printing systems, the ink is ejected directly onto the surface of an image receiving media. In indirect printing processes, the ink is first ejected onto an intermediate substrate, for example a rotating drum or a rotating closed loop web, in order to form an image on the intermediate substrate, and subsequently the image is transferred from the intermediate substrate onto the image receiving media such as a sheet of paper, transparency and the like. In indirect printing systems, the device includes a transfer roller that applies pressure to the back of a sheet of media as the sheet of media is transported between the intermediate substrate and the transfer roller.

In direct and indirect systems, the quality of the image formed on the sheet of media may be influenced by, among other things, the positioning of the inkjet print head, the positioning of ink jets within the inkjet print head and the ability for the ink jets to consistently eject ink. For example, the whole print head can become misaligned, or ink jets within the inkjet print head can become clogged. The ink jets can also become misaligned such that ink is not consistently ejected in the same direction. Solid inkjet print heads are prone to randomly develop defects such as overall misalignment and clogged or misaligned jets. Once an inkjet head or ink jets thereof becomes defective, it will remain defective until the defects are corrected. Typically, some maintenance is required in order to correct the inkjets and/or inkjet print heads. The defect will thus remain with the inkjet print head until some maintenance is performed. The maintenance may include a purging operation or a realignment of the inkjet head or the ink jets thereof.

Conventionally, in order to determine whether the inkjet print head or one or more ink jets thereof is defective, an image would be printed onto an image receiving media and the image visually inspected in order to detect defects in the ink jets and/or inkjet print head. However, such inspections sometimes miss minor defects. Further, even when defects are found, the location of any ink jets that are defective is still difficult to locate.

In the present application, difficulty arises with respect to attempting to evaluate an inkjet print head and the ink jets thereof where the inkjet print head provides a substantially clear ink onto an image receiving substrate. Because the ink is substantially clear, it is not capable of being detected by an image sensor. The present application addresses this and other issues, for example through the inclusion of an ultraviolet or infrared sensitive material in the substantially clear ink, which additive does not substantially affect the appearance of the substantially clear ink under ambient light conditions, but permits the ink to appear with a detectable color or light intensity when exposed to activating radiation which the ultraviolet or infrared sensitive material absorbs. A radiation emitting device, for example an ultraviolet LED, infrared emitting device and the like, is provided upstream of or at an image sensor. When the ultraviolet or infrared sensitive material is activated by being exposed to the appropriate activating radiation, the image sensor is able to detect at least the presence or absence of the ink at locations the ink should be present in a printed test image, and the intensity of the ink at those locations, which is indicative of the amount of ink at that location, and thus to detect the presence of a defective head or ink jet.

Ink jet defects may be caused by material clogging or partially clogging the defective jet. When an ink jet is clogged or partially clogged, the clog may influence, for example, drop mass, drop velocity, and/or drop direction. Print heads and the ink jets thereof may become defective as the mechanical, timing, image alignment, and registration attributes of the print head vary with time and usage. Ink jet and print head defects require occasional readjustment. Herein, an inkjet print head will be considered defective if the print head is misaligned or if at least one ink jet within that print head is defective.

In detecting defective print heads and ink jets, an image on drum (IOD) or image on web array (IOWA) sensor may be used to allow a device to measure the various defects or variations (for example, clogged ink jets and or misalignment of ink jets and/or print heads). An IOD or IOWA sensor is an image sensor configured to monitor, for example, the presence, intensity, and/or location of marking material jetted onto a substrate by the ink jets of the print head(s). An IOD or IOWA sensor could generally include, for example, a light source and one or more optical detectors situated to detect marking material on a substrate.

The systems and methods herein may be either direct or indirect. In a direct printing system and method, the substrate is an image receiving media. The test image for evaluation is jetted directly onto the image receiving media substrate, and the test image on the image receiving media is then subjected to the evaluation for a defective print head or ink jets. In an indirect printing system and method, the substrate upon which the test image to be evaluated is either an image receiving media or an intermediate substrate. For example, in the indirect system, the image is first formed on an intermediate substrate by jetting from the inkjet print head. The test image on the intermediate substrate may be evaluated for inkjet print head or ink jet defects. The test image on the intermediate substrate may then subsequently be removed from the intermediate substrate without transfer to an image receiving media, or the test image may be transferred to an image receiving media substrate after evaluation and the media discarded. Alternatively, the test image may be transferred to the image receiving media substrate prior to being evaluated, and the test image on the image receiving substrate evaluated for defects in the inkjet print head or ink jets in the same manner as above for the direct printing system and method. Substrate as used generally herein thus may refer to either the image receiving media substrate or to the intermediate substrate.

In the methods herein, the test image to be evaluated may be formed either over an existing image on the substrate, for example an existing color image, or may be formed on a portion of the substrate including no other image portions thereon.

Figure 2:
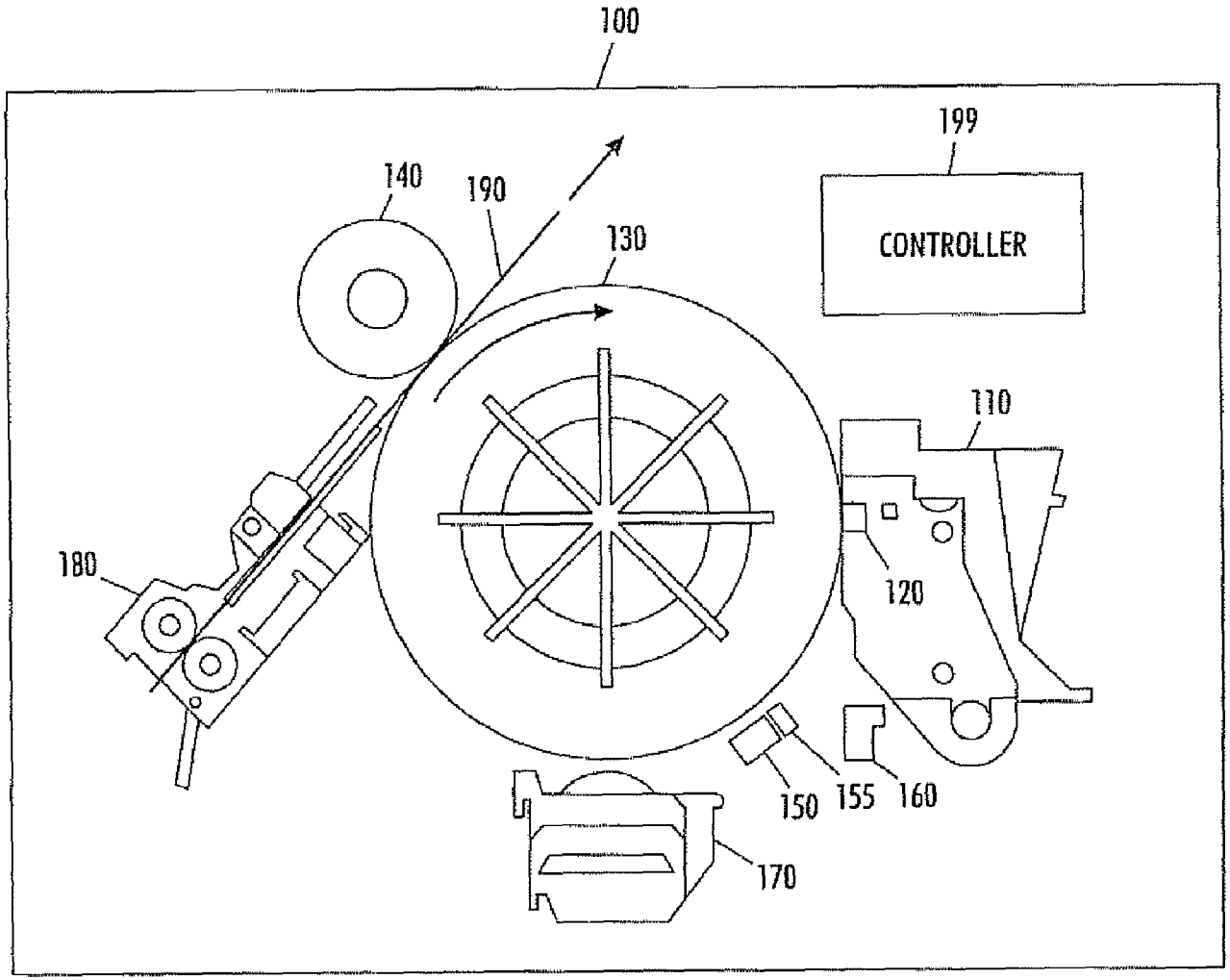
FIG. 2 shows the inkjet device of FIG. 1 configured to transfer images marked on the drum to media.
Figure 3:
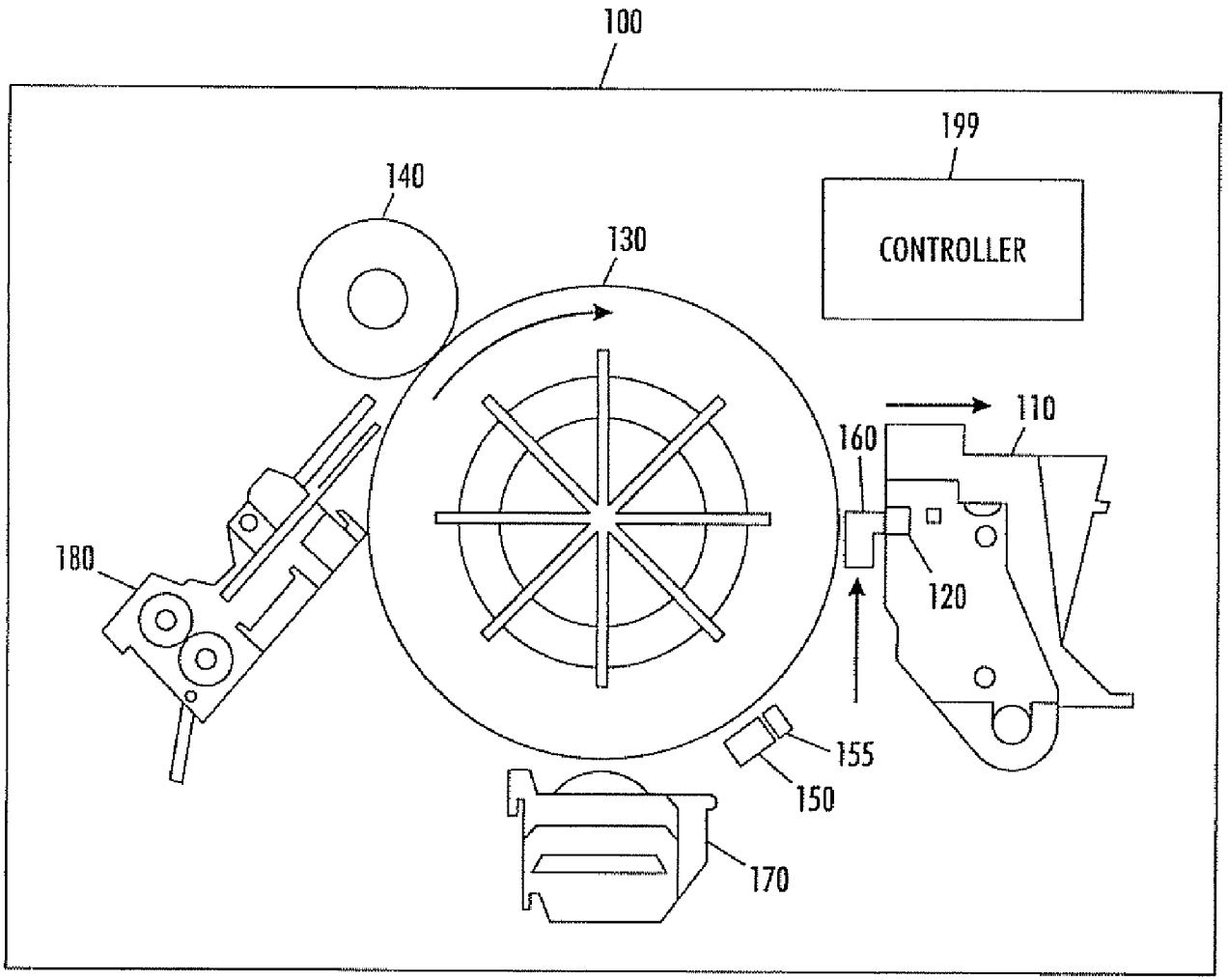
FIG. 3 shows the inkjet device of FIG. 1 configured to perform maintenance on the print head.

For a general understanding of an inkjet device, such as, for example, a solid inkjet printer, an inkjet printer, or an inkjet facsimile machine, in which the features herein may be incorporated, reference is made to FIGS. 1-3. FIGS. 1-3 illustrate a device using an intermediate substrate. However, it is here again emphasized that the systems and methods herein are equally applicable to direct printing systems where the images are jetted directly onto image receiving media without use of an intermediate substrate. Illustration of a direct system is not necessary, as the modification to such system from the illustrated indirect systems is evident to practitioners in the art.

As shown in FIG. 1, an exemplary inkjet device 100 includes, in part, a print head 110 having one or more inkjets 120, an intermediate substrate (intermediate transfer drum 130), a transfer roller 140, an image sensor 150, a radiation emitting source 155, a print head maintenance unit 160, a drum maintenance unit 170, a media pre-heater 180 that constitutes a portion of the media feed path, and a controller 199. When configured to mark an image on the intermediate transfer drum 130, as shown in FIG. 1, the print head 110, under the control of the controller 199, is positioned in close proximity to the intermediate transfer drum 130. As a result, under the control of the controller 199, the one or more ink jets 120 deposit marking material on the intermediate transfer drum 130 to form an image. While the marking material is being deposited on the intermediate transfer drum 130, the transfer roller 140 is not in contact with the intermediate transfer drum 130.

The intermediate substrate may take any suitable form, for example it may be in the form of a drum or of a closed loop web and the like. In the exemplary embodiments shown, the intermediate substrate is illustrated as a drum 130. Any materials known in the art to be used, or that are developed in the future for use, as inkjet transfer members may be used.

According to various exemplary embodiments, a single image may cover the entire intermediate transfer drum 130 (single-pitch). According to various other exemplary embodiments, a plurality of images may be marked on the intermediate transfer drum 130 (multi-pitch). Furthermore, the images may be marked in a single pass (single pass method), or the images may be marked in a plurality of passes (multi-pass method). When images are marked on the intermediate transfer drum 130 according to the multi-pass method, under the control of the controller 199, a small amount of marking material representing the image is marked by the ink jets 120 during a first rotation of the intermediate transfer drum 130. Then during one or more subsequent rotations of the intermediate transfer drum 130, under the control of the controller 199, marking material representing the same image is laid on top of the original image thereby increasing the total amount of marking material representing the image on the intermediate transfer drum 130. For application of a substantially clear ink, as either a patterned or complete coating, the application is typically done in a single pass.

In a multi-pitch marking architecture, the surface of the intermediate substrate is partitioned into multiple segments, each segment including a full page image and an inter-document zone. For example, a two pitch intermediate transfer drum 130 is capable of marking two images, each corresponding to a single sheet of media 190, during a revolution of the intermediate transfer drum 130. Likewise, for example, a three pitch intermediate transfer drum 130 is capable of marking three images, each corresponding to a single sheet of media 190, during a pass or revolution of the drum.

Once an image or images have been marked on the intermediate transfer drum 130, under the control of the controller 199, the exemplary inkjet device 100 may convert to a configuration for transferring the image or images from the intermediate transfer drum 130 onto a sheet of media 190. According to this configuration, shown in FIG. 2, a sheet of media 190 is transported through an optional media pre-heater 180, under the control of the controller 199, to a position adjacent to and in contact with the intermediate transfer drum 130. When the sheet of media 190 contacts the intermediate transfer drum 130, the transfer roller 140 is positioned in a transfer position, under the control of the controller 199, to apply pressure on the back side of the media in order to press the media against the intermediate transfer drum 130 (FIG. 2). The pressure created by the transfer roller 140 on the back side of the sheet of media 190 facilitates the transfer of the marked image from the intermediate transfer drum 130 on to the sheet of media 190.

Due to the movement, in this case rotation, of the intermediate transfer drum 130 and the transfer roller 140 (shown by arrows in FIG. 2), the image or images on the intermediate transfer drum 130 is/are transferred onto the sheet of media 190, or sheets of media 190, while the sheet of media 190, or sheets of media 190, are transported through the exemplary inkjet device 100 (in a direction shown by an arrow in FIG. 2).

Once an image is transferred from the intermediate transfer drum 130 onto a sheet of media 190, as discussed above, the intermediate transfer drum 130 continues to rotate and, under the control of the controller 199, any residual marking material left on the intermediate transfer drum 130 is removed by the drum maintenance unit 170.

When it is determined that print head maintenance is required, for example where a defective ink jet 120 or print head 110 is detected as a result of an evaluation of a test image on a substrate, the inkjet device 100, under the control of the controller 199, may enter, for example, a print head maintenance mode, shown in FIG. 3. During print head maintenance, under the control of the controller 199, the print head may be retracted from the intermediate transfer drum 130 (as shown by an arrow in FIG. 3) and, under the control of the controller 199, a print head maintenance unit 160 is positioned adjacent the inkjets 120. The print head maintenance unit 160, under the control of the controller 199, purges the ink jets 120 to correct any clogged or partially clogged jets. If the print head 110 or an ink jet 120 thereof is misaligned, under the control of the controller 199, realignment may be effected. If the jet intensity of inkjets within the print head is outside a predetermined range, under the control of the controller 199, the jet intensity of the print head, one or more groups of ink jets within the print head, and/or one or more ink jets may be adjusted.

Exemplary embodiments herein mark a test image on a substrate, either an image receiving media or an intermediate substrate as discussed above. The test image may be embedded within a print run.

As has been discussed above, the systems and methods herein are for use with an inkjet print head that prints a substantially clear ink. Substantially clear ink herein refers to, for example, the ink having an appearance that is substantially transparent to a naked human eye under substantially ambient lighting conditions, and thus has no perceptible color or hue to the naked human eye. The substantially clear ink may have a perceptible gloss to the naked human eye. The substantially clear ink may be either a solid or liquid ink, although the ink is most typically a solid ink jet ink that is solid at room temperatures and that is heated to at or above its melting temperature for jetting through the inkjet print head.

Also as has been discussed above, a conventional image sensor system, designed for the detection of pigmented or dyed marking materials, such as image sensor 150 is not capable of evaluating the image formed by the substantially clear ink on the substrate as the image lacks detectable color. Herein, this is addressed by (1) including an ultraviolet or infrared sensitive and/or absorbent material in the substantially clear ink, and (2) including at or upstream of (in an image formation process direction) the image sensor, a radiation emitting source that emits radiation, or light, having a wavelength at which the ultraviolet or infrared sensitive material absorbs or reflects, thereby activating the ultraviolet or infrared sensitive material and causing contrast with respect to an unmarked substrate so that the image is detectable by the image sensor. The image must proceed to the image sensor while the ultraviolet or infrared sensitive material is activated as a result of the exposure to the activating radiation.

As shown in FIGS. 1-3, the inkjet print head is upstream of the image sensor and radiation emitting device, in an image formation process direction, which sensor and emitting device are in turn upstream of the transfer device. The intermediate substrate is configured to move, or rotate, past each of these devices in the image formation process. The intermediate substrate maintenance unit is downstream from the transfer device. In a direct print system, the inkjet print head would again be upstream of the radiation emitting device and image sensor, and following jetting of an image onto the image receiving media, the image receiving media would proceed along a pathway past the radiation emitting device and the image sensor.

The substantially clear ink typically comprises at least an ink vehicle or binder and at least one ultraviolet (UV) or infrared (IR) sensitive material.

As the ink vehicle, any ink or toner vehicles may be suitably used. For phase change solid inks, the vehicle may be any of those described in U.S. patent application Ser. No. 11/548,775, U.S. Pat. No. 6,906,118 and/or U.S. Pat. No. 5,122,187, each incorporated herein by reference in its entirety. The ink vehicle may also be UV radiation curable, for example any of the ink vehicles described in U.S. patent application Ser. No. 11/548,774, incorporated herein by reference in its entirety. The ink vehicle may also be any toner polymer binder, for example such as a polyester or a polyacrylate and the like.

The ink vehicle may also include a wax such as paraffins, microcrystalline waxes, polyolefin waxes such as polyethylene or polypropylene waxes, ester waxes, fatty acids and other waxy materials, fatty amide containing materials, sulfonamide materials, resinous materials made from different natural sources (tall oil rosins and rosin esters, for example), and synthetic waxes. The wax may be present in an amount of from about 5% to about 25% by weight of the ink. Examples of suitable waxes include polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected usually possess a molecular weight of from about 1,000 to about 1,500, while the commercially available polypropylenes utilized for the toner compositions of the present invention are believed to have a molecular weight of from about 4,000 to about 5,000. Examples of suitable functionalized waxes include, for example, amines, amides, imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson wax.

In embodiments, the UV or IR sensitive material is any UV or IR sensitive material that does not significantly negatively impact the substantial clearness and/or transparency of the substantially clear ink. That is, the material should be such that the substantially clear ink remains substantially clear to the naked human eye under substantially ambient lighting conditions. An advantage in using such materials is that the substantially clear ink can be made to be invisible in ambient light, and only becomes visible and machine detectable upon exposure to radiation such as UV or IR light at which the material absorbs radiation so as to become activated and, for example, fluoresces or otherwise emits radiation that is itself detectable by the image sensor. The UV or IR sensitive material is sensitive to an activating radiation, for example a radiation having a wavelength from about 10 nm to about 1,000 nm, such as from about 10 nm to about 400 nm (the UV light range) or from about 700 nm to about 1,000 nm (the IR light range). The activating radiation may thus be in the ultraviolet (UV) or infrared (IR) regions.

When the UV or IR sensitive material is included in the substantially clear ink, the printed image is not visible or apparent to a viewer in ambient light. Upon exposure to the activating radiation to which the UV or IR sensitive material is sensitive, the material provides a detectable contrast, for example by emitting a color or brightness intensity, that causes the ink to become detectable by the image sensor.

The UV or IR absorbing material may be present in the substantially clear ink in any desired amount, and desirably present in an amount effective to impart a desired color and intensity (for example, fluorescence) under the appropriate radiation (for example, UV or IR light) conditions. For example, the material may be present in the ink in an amount of from about 0.1 to about 25% by weight, such as from about 0.5 to about 20% by weight or from about 1 to about 15% by weight, of the ink.

In embodiments, the UV sensitive material may be a fluorescent material, that is, a material that fluoresces upon absorbing radiation or light having an activating wavelength for the material. Fluorescent refers to, for example, the capability of a material to fluoresce upon exposure to the activating radiation. The fluorescing may occur instantaneously on exposure to the activating radiation, or may occur after overcoming any activation phase. The fluorescing exhibited by the UV sensitive material is reversible, but should last for a time period permitting the color change or brightness intensity change to be detected by the image sensor, for example a time frame of from about 0.1 seconds to about 1 hour, such as from about 0.5 seconds to about 30 minutes or from about 0.5 seconds to about 5 minutes.

Suitable fluorescent materials include, for example, fluorescent dyes, fluorescent pigments and inorganic quantum nanoparticle materials. Examples of fluorescent dyes include those belonging to dye families such as rhodamines, fluoresciens, coumarins, napthalimides, benzoxanthenes, acridines, azos, mixtures thereof and the like. Suitable fluorescent dyes include, for example, Basic Yellow 40, Basic Red 1, Basic Violet 11, Basic Violet 10, Basic Violet 16, Acid Yellow 73, Acid Yellow 184, Acid Red 50, Acid Red 52, Solvent Yellow 44, Solvent Yellow 131, Solvent Yellow 85, Solvent Yellow 135, solvent Yellow 43, Solvent Yellow 160, Fluorescent Brightener 61, mixtures thereof and the like. Other suitable fluorescent dyes include oil and solvent based dyes such as DFSB class, DFPD class, DFSB-K class available from Risk Reactor. Suitable fluorescent pigments include, for example, those available from Day-Glo Color Corp., such as aurora pink T-11 and GT-11, neon red T-12, rocket red T-13 or GT-13, fire orange T-14 or GT-14N, blaze orange T-15 or GT-15N, arc yellow T-16, saturn yellow T-17N, corona magenta GT-21 and GT-17N, mixtures thereof and the like. Other suitable fluorescent pigments available from Risk Reactor are for example PFC class, such as PFC-03, which switches from invisible to red when exposed to UV light, and PF class such as PF-09, which switches from invisible to violet when exposed to UV light. Other suppliers of fluorescent materials include Beaver Luminescers and Cleveland Pigment & Color Co.

Specific examples of UV sensitive materials include 4,4'-bis(styryl)biphenyl, 2-(4-phenylstilben-4-yl)-6-butylbenzoxazole, beta-methylumbelliferone, 4,-methyl-7-dimethylamino coumarin, 4-methyl-7-aminocoumarin, N-methyl-4-methoxy-1,8-naphthalimide, 9,10-bis(phenethynyl) anthracene, 5,12-bis(phenethynyl)naphthacene, DAYGLO INVISIBLE BLUE and the like.

Quantum nanoparticle materials are fluorescent inorganic semiconductor nanoparticle materials (also known as quantum dots). The light emission of quantum nanoparticles is due to quantum confinement of electrons and holes. An advantage of quantum nanoparticles is that they can be tuned so that they emit any desired wavelength (color) as a function of their size, by using one material only and the same synthetic process. For example, in a nanoparticle size range of from about 2 to about 10 nm, one can obtain a full range of colors from the visible range of the spectrum. In addition, quantum nanoparticles possess improved fatigue resistance when compared with organic dyes. Another advantage of quantum nanoparticles is their narrow emission bands. Due to their small size, typically less than about 30 nm, such as less than about 20 nm, marking materials containing the nanoparticles can be easily jetted. Quantum nanoparticles are available from a variety of companies, such as from Evident Technologies.

In embodiments, the quantum nanoparticles used herein are functionalized quantum nanoparticles. Surface functionalized quantum nanoparticles may have better compatibility with the vehicles of the marking materials. Suitable functional groups present on the surface of the nanoparticles for compatibility with marking material vehicles may include long linear or branched alkyl groups, for example from about 1 carbon atom to about 150 carbon atoms in length, such as from about 2 carbon atoms to about 125 carbon atoms or from about 3 carbon atoms to about 100 carbon atoms. Other suitable compatibilizing groups include polyesters, polyethers, polyamides, polycarbonates and the like. The ink containing quantum nanoparticles may be made to have very specific emission spectra. For example, the marking material may be made to have an emission range having a narrow full width half max emission range peak of about 30 nm or less, such as about 25 nm or less or about 20 nm or less. This permits the emitted color wavelength to be particularly tuned, and for the image sensor to be set to detect emissions at very specific wavelengths.

In embodiments, the substantially clear ink may be UV curable, whereupon after jetting of the image, the ink is exposed to a curing radiation to crosslink and cure the ink image. In such embodiments, it is necessary for the ink to include both a curable ink vehicle, for example an acrylate or styrene based vehicle and/or a wax vehicle, and a UV photoinitiator. The presence of the photoinitiator is sufficient to cause a change in color or brightness intensity upon exposure to UV light such that the ink becomes detectable by the image sensor. Further, the intensity and/or length of the activating radiation applied for the image sensing is typically small enough that curing of the image on the intermediate transfer substrate does not occur to any significant degree, and subsequent curing of the ink is not substantially adversely affected.

UV curable ink vehicles are well known in the art. Examples of photoinitiators that may be used in a UV curable ink include the phosphine oxide class of photoinitiators such as diphenyl-(2,4,6-trimethylbenzoyl)phospine oxide, 1-hydroxy-cyclohexylphenyltketone, benzophenone, 2-benzyl-2-(dimethylamino)-1-(4-(4-morphorlinyl)phenyl)-1-butanone, 2-methyl-1-(4-methylthio)phenyl-2-(4-morphorlinyl)-1-propanone, diphenyl-(2,4,6-trimethylbenzoyl)phospine oxide, phenyl bis(2,4,6-trimethylbenzoyl)phosphine oxide, benzyl-dimethylketal, isopropylthioxanthone, a combination of isopropylthioxanthone or benzophenone and a suitable amine functionality such as the oligomer PO94 F from BASF or small molecule amines such as ethyl 4-(dimethylamino) benzoate, mixtures thereof and the like. This list is not exhaustive; any known photoinitiator that can be used in the composition of an ink may be used.

The photoinitiators initiate the polymerization of activated carbon-carbon double bonds to form chains of single bonds. Activation of carbon-carbon double bonds to free radical polymerization is generally achieved through conjugation with other double bonds such as occurs with acrylate, methacrylate and styrenic groups. Styrene derivatives often have other photochemical pathways available to them that interfere with the desired polymerization or curing of the ink.

Examples of infrared sensitive materials include IR sensitive dyes such as phthalocyanines, carbocyanines, dicarbocyanines, tricarbocyanines, tetracarbocyanines and pentacarbocyanines. For example, the IR sensitive dyes include metal phthalocyanines, vanadyl phthalocyanine, dihydroxygermanium phthalocyanines like copper phthalocyanine, and metal free phthalocyanines, octa-alkoxyphthalocyanine and naphthalocyanine derivatives, 3,3'-diethylthiatricarbocyanine, 5,5'-dichloro-11-diphenylamino-3,3'-diethyl-10,12'-ethylene-thiatricarbocyanine perchlorate, anhydro-11-(4-ethoxycarbonyl-1-piperazinyl)-10,12-ethylene-3,3,3',3'-tetraethyl-1,1'-di(3-sulfopropyl)-4,5,4',5'-dibenzoindotricarbocyanine hydroxide, dyes with Q-band absorption in the far or near infrared (M. J. Cook, A. J. Dunn, S. D. Howe, A. J. Thomson, and K. J. Harrison, J. Chem. Soc. Perkin Trans., 1 (1988), 2453, the disclosure of which is totally incorporated herein by reference), combinations thereof and the like.

The systems and methods herein also include use of a radiation emitting source (for example, 155 in FIGS. 1-3) located upstream of or at the image sensor, wherein the radiation emitting source emits radiation, or light, having a wavelength to which the ultraviolet or infrared sensitive material is sensitive, for example at which the material absorbs the radiation, thereby activating the material. In this way, the image sensor can detect the presence or absence of the substantially clear ink, and the amount of the ink (due to relative intensity), without the image quality or appearance having to be compromised.

As the radiation emitting source, any suitable source presently known in the art or that may become known in the future may be used. As one example, a light emitting diode (LED), for example a UV emitting LED, may be used where the sensitive material included in the ink is UV sensitive. An AlGaN alloy LED, for example, may emit light in the 320 to 360 nm wavelength range. IR emitting sources are also readily known and available. Commercially available lights include, for example, SpecBright™ lights.

In the process and system, the radiation emitting source must be provided at or in advance of the image sensor with respect to the rotation direction of the intermediate substrate. Following printing of the substantially clear ink on the substrate, the ink is exposed to the activating radiation provided by the radiation source. The exposure should be for a sufficient time and intensity to permit the UV or IR sensitive material to sufficiently absorb the radiation and subsequently create contrast due to the absorption of the radiation. Exposure may be for any desired or effective period of time, for example, from about 0.01 second to about 30 seconds, such as from about 0.01 second to about 15 seconds or from about 0.01 second to about 5 seconds. Where the emission continues for a period of time even after the exposure to the activating radiation is ceased, the activating radiation providing source may be turned off and the image then subjected to evaluation by the image sensor. This may be advantageous where the activating radiation providing source may interfere with an accurate detection by the image sensor. Of course, it is also possible to have the activating radiation remain on during the evaluation of the printed image, formed by the substantially clear ink, by the image sensor. A requirement for image sensing is that the UV or IR sensitive material be activated during the image sensing, such that detectable contrast is still present.

In the process, a test image is marked on the substrate (image receiving media or intermediate substrate) by jetting the substantially clear ink through one or more jets of the inkjet print head to be evaluated. It is not necessary to evaluate all of the jets of the inkjet print head at the same time. It may be desirable for the evaluation to conduct an evaluation on only a single ink jet or upon ink jets in a same column of the inkjet print head. In this way, the possible misalignment of ink jets may be more readily detected, for example because substantially clear ink will be detected on portions of the substrate where it should not be present. Of course, it is also possible to evaluate the entire inkjet print head and all of the ink jets at the same time.

In the methods described herein, the system is capable of forming both a substantially clear image on an image receiving substrate during a printing mode and is capable of forming a test image on the substrate for evaluation by the image sensor during an ink jet evaluation mode.

In the printing mode in an indirect system, the transfer device is moved into a transfer position, wherein the transfer device is brought into proximity to the intermediate substrate surface. In this way, a substantially clear ink image formed on the intermediate substrate surface may be transferred to an image receiving substrate, as discussed above. In evaluation mode, the transfer device may be in the transfer position, in which case the test image is transferred to an image receiving substrate for discarding, or it may be moved to a non-transfer position away from the surface of the image receiving substrate, in which case the test image, after evaluation, is removed from the intermediate surface by the intermediate surface maintenance device, as discussed above.

Moreover, in evaluation mode, if one of the test images is evaluated by the controller and the controller determines that the inkjet print head or one or more ink jets are defective, then, under the control of the controller, the marking operation may be paused or terminated and print head maintenance and/or realignment may be performed.

The formation of test images for evaluation may occur at any time, for example between print jobs, at the beginning of a print job, or in the middle of a print job. For multi-pitch intermediate substrates, the test image may be formed on one of the pitches not being used during a print job on a given rotation of the intermediate substrate. In this way, down time of the device for evaluations may be minimized. It may also be advantageous to mark test images on blank pitches at the beginning of an image sequence or print job. If the image sequence is large and there is a defective ink jet and/or print head, the defect will be detected before a substantial amount of images are marked and transferred to sheets of media. Typically, when a substantial amount of images are marked and transferred to sheets of media using a defective ink jet and/or print head, all of the resources utilized to mark and transfer the images will be wasted since the images will reflect the defects of the defective ink jet and/or print head.

During an evaluation of a test image, the speed of movement of the image receiving media or of the intermediate substrate may be adjusted, for example slowed, if necessary to ensure proper evaluation of the test image.

Although, for ease of explanation, the above embodiments are described within the context of an inkjet device having one print head, various other embodiments may include more than one print head. Furthermore, although, for ease of explanation, the above described embodiments are described within the context of an inkjet device having one controller, various other embodiments may use more than one controller within the device, and/or at least one controller outside the device, such as in a locally or remotely located laptop or personal computer, a personal digital assistant, a tablet computer, a device that stores and/or transmits electronic data, such as a client or a server of a wired or wireless network, an intranet, an extranet, a local area network, a wide area network, a storage area network, the Internet (especially the World Wide Web), and the like. In general, the one or more controllers may be in any known or later-developed source that is capable of providing control signals to an inkjet device.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for detecting a defect in an inkjet print head for printing a substantially clear ink, comprising:

including an ultraviolet or infrared sensitive material in the substantially clear ink;

marking a test image on an intermediate substrate by jetting the substantially clear ink through one or more jets of the inkjet print head to be evaluated;

exposing the test image to activating radiation having a wavelength to which the included ultraviolet or infrared sensitive material responds;

during or following the exposing, and while the ultraviolet or infrared sensitive material is responding to the exposing, evaluating the test image with an image sensor, and wherein the test image is exposed and evaluated while remaining on the intermediate substrate; and determining whether the inkjet print head or any one of the one or more jets thereof is defective based on the evaluation.

2. The method according to claim 1, wherein the included ultraviolet or infrared sensitive material is an ultraviolet sensitive material selected from the group consisting of rhodamines, fluoresciens, coumarins, napthalimides, benzoxanthenes, acridines, azos, 4,4'-bis(styryl)biphenyl, 2-(4-phenylstilben-4-yl)-6-butylbenzoxazole, beta-methylumbelliferone, 4,-methyl-7-dimethylamino coumarin, 4-methyl-7-aminocoumarin, N-methyl-4-methoxy-1,8-naphthalimide, 9,10-bis(phenethynyl)anthracene, 5,12-bis(phenethynyl) naphthacene, and combinations thereof.

3. The method according to claim 1, wherein the included ultraviolet or infrared sensitive material is an infrared sensitive dye.

4. The method according to claim 1, wherein the included ultraviolet or infrared sensitive material is an ultraviolet sensitive quantum nanoparticle.

5. The method according to claim 1, wherein the substantially clear ink is an ultraviolet curable ink and the included ultraviolet or infrared sensitive material is an ultraviolet photoinitiator of the substantially clear ink.

6. The method according to claim 1, wherein the method further comprises taking corrective action when the inkjet print head or one or more of the ink jets thereof is determined to be defective.

7. The method according to claim 6, wherein when the inkjet print head is determined to be defective by being misaligned, the corrective action comprises realigning the inkjet print head.

8. The method according to claim 1, wherein the test image is formed on the intermediate substrate over an existing color image.

9. The method according to claim 1, wherein the test image is formed on the intermediate substrate at a portion of the intermediate substrate free of any other images thereon.

10. A method for detecting a defect in an inkjet print head for printing a substantially clear ink, comprising:

including an ultraviolet or infrared sensitive material in the substantially clear ink marking a test image on an intermediate substrate by jetting the substantially clear ink through one or more jets of the inkjet print head to be evaluated;

transferring the test image from the intermediate substrate to an image receiving media;

exposing the test image to activating radiation having a wavelength to which the included ultraviolet or infrared sensitive material responds;

during or following the exposing, and while the ultraviolet or infrared sensitive material is responding to the exposing, evaluating the test image with an image sensor, wherein the test image is transferred from the intermediate substrate to the image receiving media prior to the exposing and the evaluating, the test image on the image receiving substrate being exposed and evaluated; and determining whether the inkjet print head or any one of the one or more jets thereof is defective based on the evaluation.

11. A method for forming a substantially clear ink image on an image receiving substrate, comprising:

a process of forming an image comprised of substantially clear ink on an image receiving media by forming a pattern of substantially clear ink onto a surface of the image receiving media by jetting the substantially clear ink through one or more ink jets of an inkjet print head, wherein the jetting is indirect by jetting onto an intermediate substrate with the pattern subsequently being transferred from the intermediate substrate to the surface of the image receiving media, and wherein the substantially clear ink includes an ultraviolet or infrared sensitive material; and a process of forming a test image for evaluation of defects in the inkjet print head or the one or more ink jets thereof by:

forming the test image comprised of the substantially clear ink by jetting the substantially clear ink through the one or more jets of the inkjet print head, wherein during the process of forming the test image, a transfer device is in a non-transfer position away from contact with the surface of the intermediate substrate;

moving the test image past a radiation emitting device that emits radiation at a wavelength to which the ultraviolet or infrared sensitive material is sensitive to cause the ultraviolet or infrared sensitive material to be activated, and moving the test image past an image sensor while the ultraviolet or infrared sensitive material is activated, where the test image is evaluated; and determining whether the inkjet print head or any of the one or more jets thereof is defective based on the evaluation.

12. The method according to claim 11, wherein the test image is moved past the radiation emitting device and past the image sensor when the test image is either on the intermediate substrate or on the image receiving media.

13. The method according to claim 11, wherein the process of forming a test image is performed when the process of forming the image is not performed.

14. A system for detecting a defect in one or more ink jets of an inkjet print head that prints a substantially clear ink, comprising:

an inkjet print head associated with an intermediate substrate onto which an image comprised of substantially clear ink including an ultraviolet or infrared sensitive material is first formed;

an image sensor downstream from the inkjet print head, wherein the intermediate substrate moves past the image sensor following forming of an image comprised of substantially clear ink including an ultraviolet or infrared sensitive material on the intermediate substrate by the inkjet print head;

a transfer device downstream from the image sensor, wherein the image first formed on the intermediate substrate is transferred to an image receiving media at the transfer device; and a radiation emitting source, located upstream of or at the image sensor, wherein the radiation emitting source emits radiation having a wavelength activating the ultraviolet or infrared sensitive material of the substantially clear ink.

15. The system according to claim 14, wherein the transfer device is movable between a transfer position in proximity to the intermediate substrate and a non-transfer position retracted from the intermediate substrate.

16. The system according to claim 14, wherein the system further includes an inkjet print head maintenance device, wherein the inkjet print head maintenance device corrects clogs or misalignments detected in the one or more ink jets of the inkjet print head, and/or corrects misalignments detected in the inkjet print head.

17. The system according to claim 16 wherein during an inkjet print head maintenance mode, the inkjet print head maintenance device moves into maintenance mode position in proximity to the inkjet print head to perform the maintenance.

* * * * *